US008267014B2

(12) United States Patent
Neff

(10) Patent No.: US 8,267,014 B2
(45) Date of Patent: Sep. 18, 2012

(54) MULTIPLE-BAY EJECTION DEVICE

(75) Inventor: Daniel R. Neff, Jasper, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 164 days.

(21) Appl. No.: 12/726,850

(22) Filed: Mar. 18, 2010

(65) Prior Publication Data

US 2011/0146483 A1 Jun. 23, 2011

Related U.S. Application Data

(60) Provisional application No. 61/289,242, filed on Dec. 22, 2009.

(51) Int. Cl.
*F42B 5/307* (2006.01)

(52) U.S. Cl. ..... 102/472

(58) Field of Classification Search ..... 102/470, 102/471, 472; 280/736, 737
See application file for complete search history.

(56) References Cited

U.S. PATENT DOCUMENTS

| | | | | |
|---|---|---|---|---|
| 3,437,245 | A * | 4/1969 | Herbert et al. | 222/389 |
| 3,512,480 | A * | 5/1970 | Barr | 102/368 |
| 3,841,219 | A | 10/1974 | Schillreff | |
| 4,135,455 | A | 1/1979 | Wallace | |
| 5,587,550 | A | 12/1996 | Willis et al. | |
| 5,631,439 | A | 5/1997 | Sallee et al. | |
| 6,206,414 | B1 * | 3/2001 | Cook et al. | 280/734 |
| 6,796,245 | B2 | 9/2004 | Parker et al. | |
| 6,860,510 | B2 * | 3/2005 | Ogawa et al. | 280/736 |
| 6,915,744 | B2 | 7/2005 | Tirmizi | |
| 6,945,561 | B2 | 9/2005 | Nakashima et al. | |
| 7,188,688 | B1 | 3/2007 | LeJeune | |
| 2003/0047104 | A1 | 3/2003 | Raz | |
| 2007/0295236 | A1 | 12/2007 | Callaway et al. | |

* cited by examiner

*Primary Examiner* — Stephen M Johnson
(74) *Attorney, Agent, or Firm* — Christopher A. Monsey

(57) ABSTRACT

An ejectable device is provided having multiple ejection bays. The ejectable device includes an impulse cartridge having multiple charges that are independently activatable. The ejectable device further includes an orientation adapter that allows reliable connectivity between the impulse cartridge and a signal source.

7 Claims, 11 Drawing Sheets

MULTIPLE-BAY EJECTION DEVICE

CROSS-REFERENCE TO RELATED APPLICATION

This application claims priority to U.S. Provisional Patent Application Ser. No. 61/289,242, filed Dec. 22, 2009, the disclosure of which is expressly incorporated by reference herein.

STATEMENT REGARDING FEDERALLY SPONSORED RESEARCH OR DEVELOPMENT

The invention described herein includes contributions by one or more employees of the Department of the Navy made in performance of official duties and may be manufactured, used, licensed by, or for the United States Government without payment of any royalties thereon.

BACKGROUND AND SUMMARY

The present disclosure relates generally to ejectors. More particularly, the present disclosure relates to ejectors having multiple bays and various components present to facilitate ejection therefrom.

According to one aspect of the present disclosure, an ejector device includes a housing having an ignition source receiving bore including a bore wall. The bore wall includes a plurality of independently actionable shear disks. Each independently actionable shear disk is associated with an independent payload bore such that the shear disk, when seated, prevents pressure from passing from the ignition source receiving bore to one of the payload bores, and the shear disk, when unseated, allows the transmission of pressure from the ignition source receiving bore to one of the payload bores. An ejectable device is disposed within each payload bore of the housing.

According to another aspect of the present disclosure, a method of manufacturing an ejection device includes the steps of obtaining a housing having an ignition source receiving bore with a bore wall. The bore wall includes a plurality of independently actionable shear disks. Each independently actionable shear disk is associated with an independent payload bore located within the housing such that the shear disk, when seated, prevents pressure from passing from the ignition source receiving bore to one of the payload bores, and the shear disk, when unseated, allows the transmission of pressure from the ignition source receiving bore to one of the payload bores. The method further includes the steps of placing an ejectable device within each payload bore of the housing, and placing a cap on the end of each payload bore to contain the ejectable device within the payload bore.

Additional features of the present disclosure will become apparent to those skilled in the art upon consideration of the following detailed description of the presently perceived best mode of carrying out the disclosure.

BRIEF DESCRIPTION OF THE DRAWINGS

The detailed description of the drawings particularly refers to the accompanying figures in which.

DETAILED DESCRIPTION OF THE DRAWINGS

Figure 1:
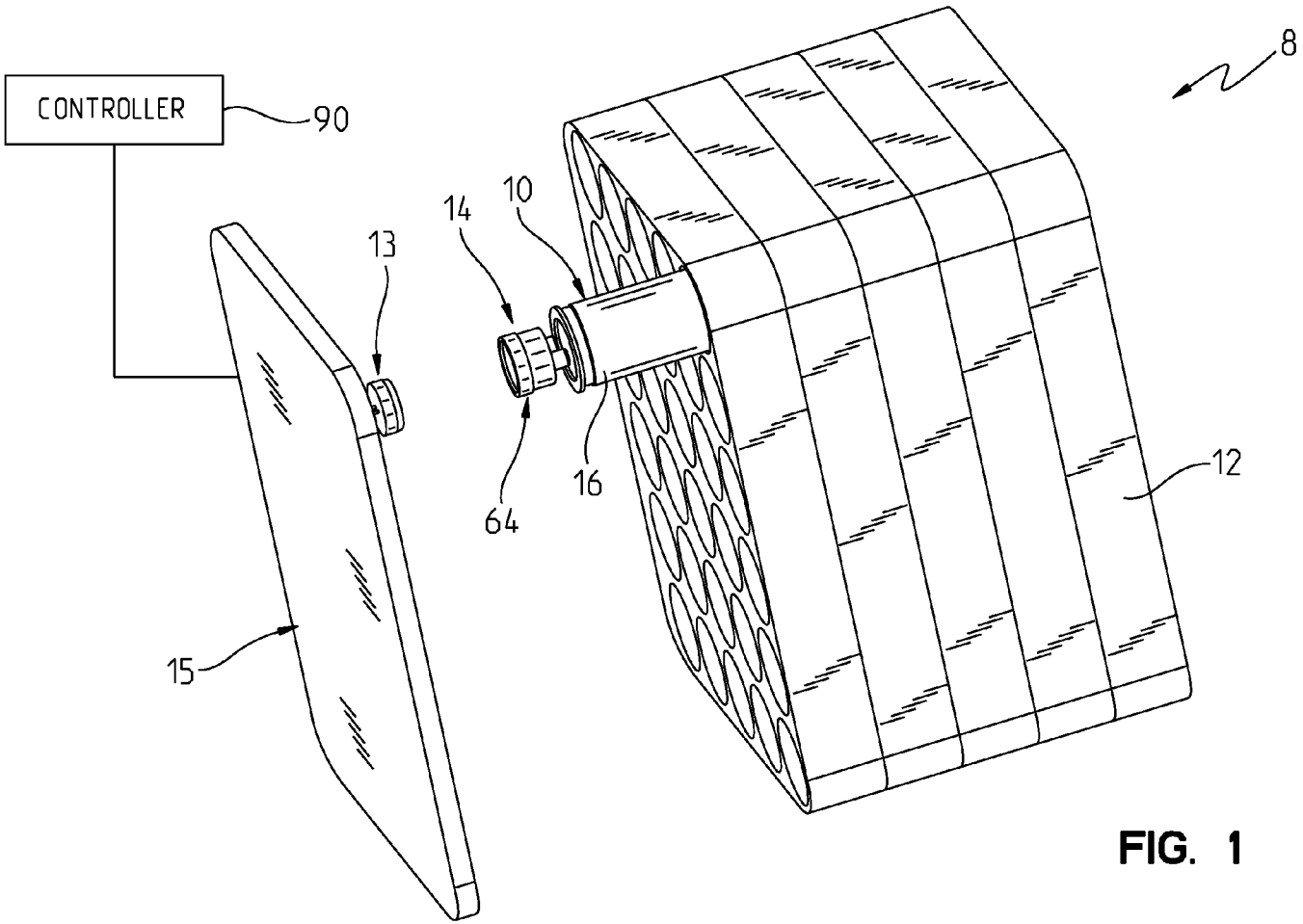
FIG. 1 is a partially exploded perspective view of an illustrative projectile ejection device disposed in a block for holding multiple projectile devices, an impulse cartridge, and an orientation adapter coupled to a breech plate.
Figure 2:
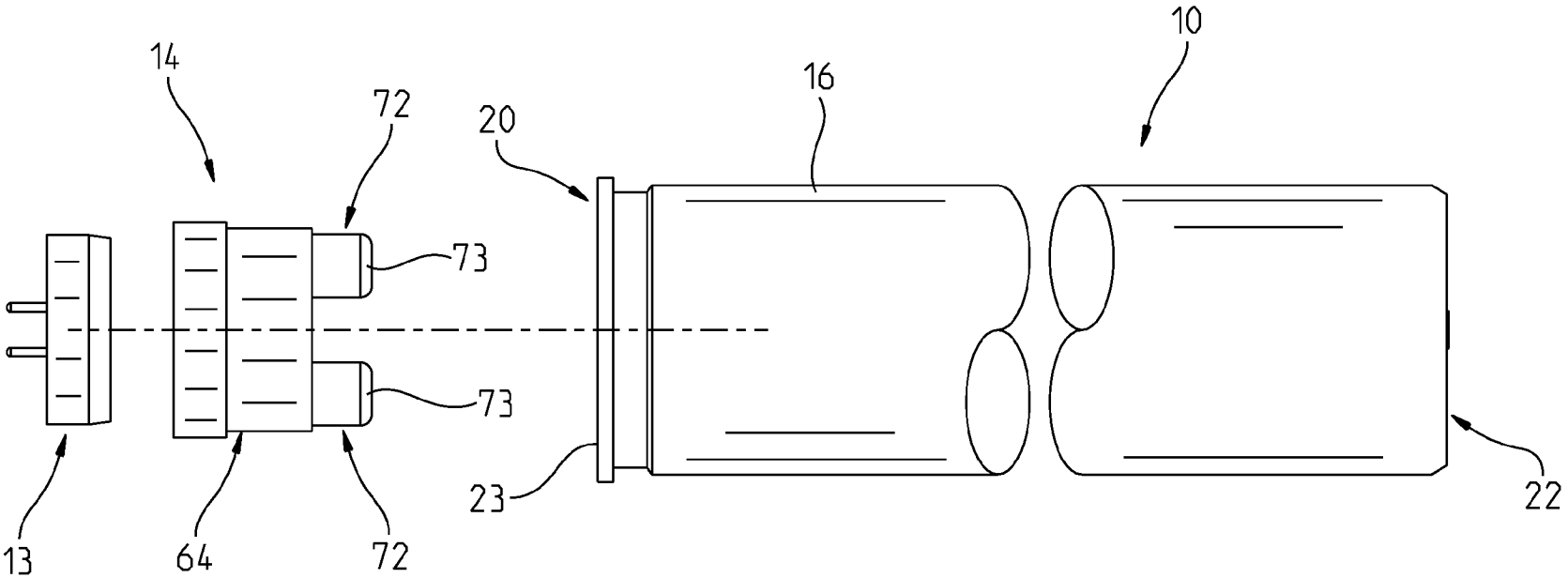
FIG. 2 is an exploded view of the projectile device, impulse cartridge, and orientation adapter of FIG. 1.

FIG. 1 shows projectile system 8 including a projectile device 10 partially disposed in block 12, shows impulse cartridge 14 positioned for installation in projectile device 10, and shows orientation adapter 13 coupled to breech plate 15 and positioned for installation in impulse cartridge 14.

Projectile device 10 includes housing 16 and end caps 18. Housing 16 is illustratively metallic (such as aluminum), substantially cylindrical, and includes propellant end 20 and ejection end 22, (step 400).

Propellant end 20 includes cartridge retainer 23 having bore 24 sized and shaped to receive impulse cartridge 14 therein. Bore 24 is defined within propellant end 20 as a multi-diametered bore having base wall 26 and side wall 28. Base wall 26 is formed having pockets 25 that receive portions of impulse cartridge 14 therein. Pockets 25 contain areas of reduced wall thickness 27 relative to other wall portions such that it forms shear disks 29 that are discussed in more detail below.

Figure 5:
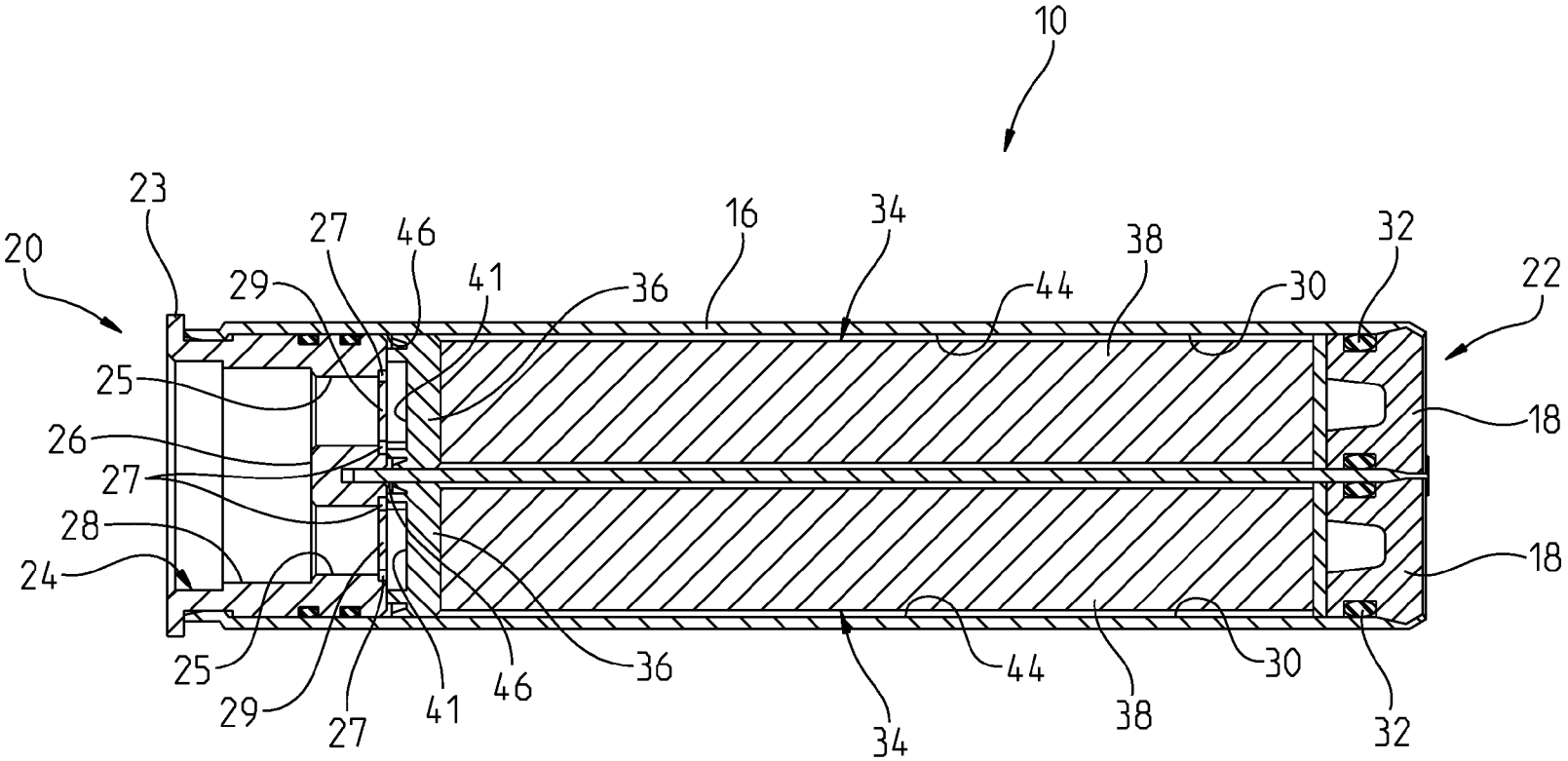
FIG. 5 is a cross-sectional view of the projectile device of FIG. 1.

Ejection end 22 is opposite propellant end 20 and illustratively includes payload bores 30 having a depth that takes up substantially all the length of housing 16 (excluding that portion of the length used to define bore 24 in propellant end 20, see FIG. 5). Payload bores 30 are sized to at least partially receive end caps 18 therein. End caps 18 include gaskets 32 that provide a seal between end caps 18 and the interior walls of payload bores 30.

As shown most clearly in FIG. 5, payload bores 30 illustratively receive payloads 34 therein (step 402). Payloads 34 include pistons 36 and projectiles 38. While the present disclosure shows projectiles 38 having multiple components, the concepts of the current disclosure can be used in many projectile accelerating applications and many pressure sealing applications. Once payloads 34 are within payload bores 30, end caps 18 are applied, (step 404).

Pistons 36 approximate pieces having a compressible perimeter slightly larger than the inner dimensions of payload bores 30. In this manner, pistons 36 separate payload bore 30 into fore chamber 44 and rear chamber 46. Furthermore, pistons 36 serve as a surface upon which pressure generated in rear chamber 46 can act, as discussed below. Projectile 38 is located in fore chamber 44. Pistons 36 may also include bores 41, FIG. 5, that are sized and shaped to receive igniter pellets therein. Alternatively, bores 41 do not receive igniter pellets therein but rather provide clearance space for the intrusion of shear disks 29.

Figure 3A:
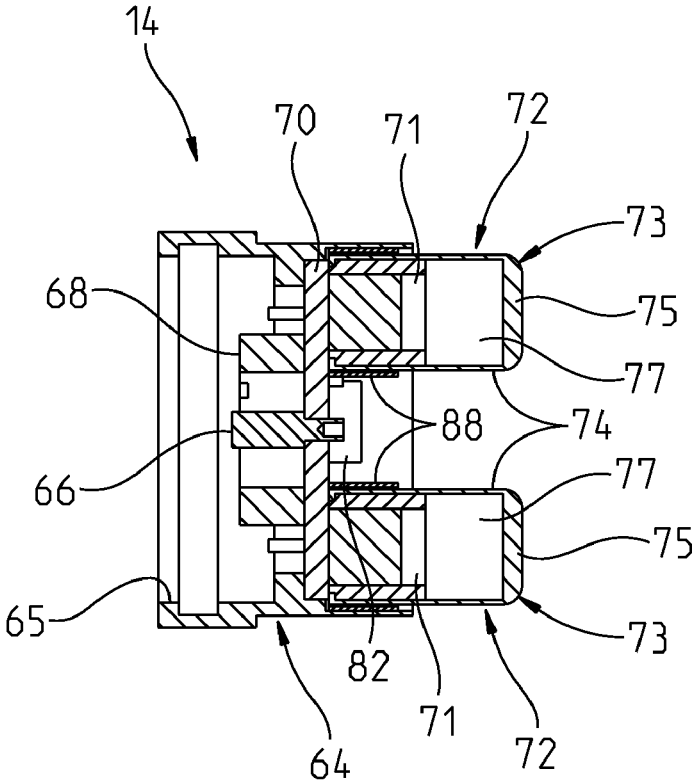
FIG. 3A is a cross-sectional view of the impulse cartridge of FIG. 1.
Figure 3B:
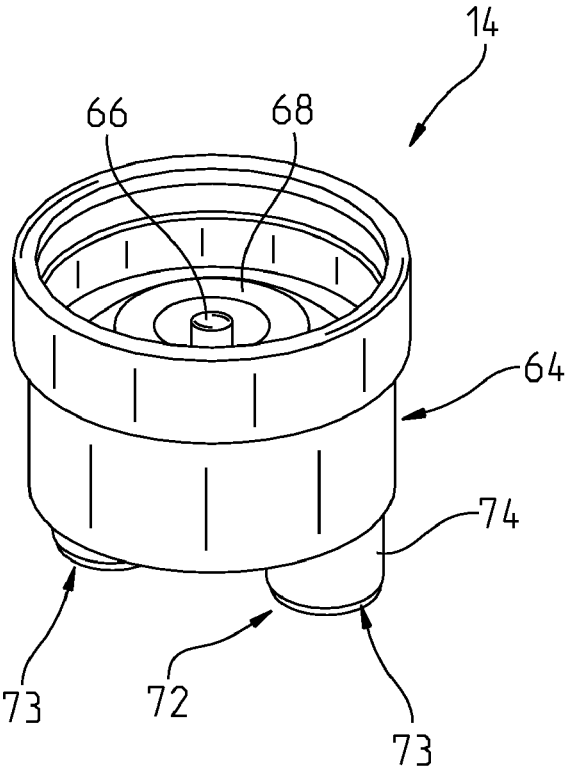
FIG. 3B is a perspective view of the impulse cartridge of FIG. 1.
Figure 3C:
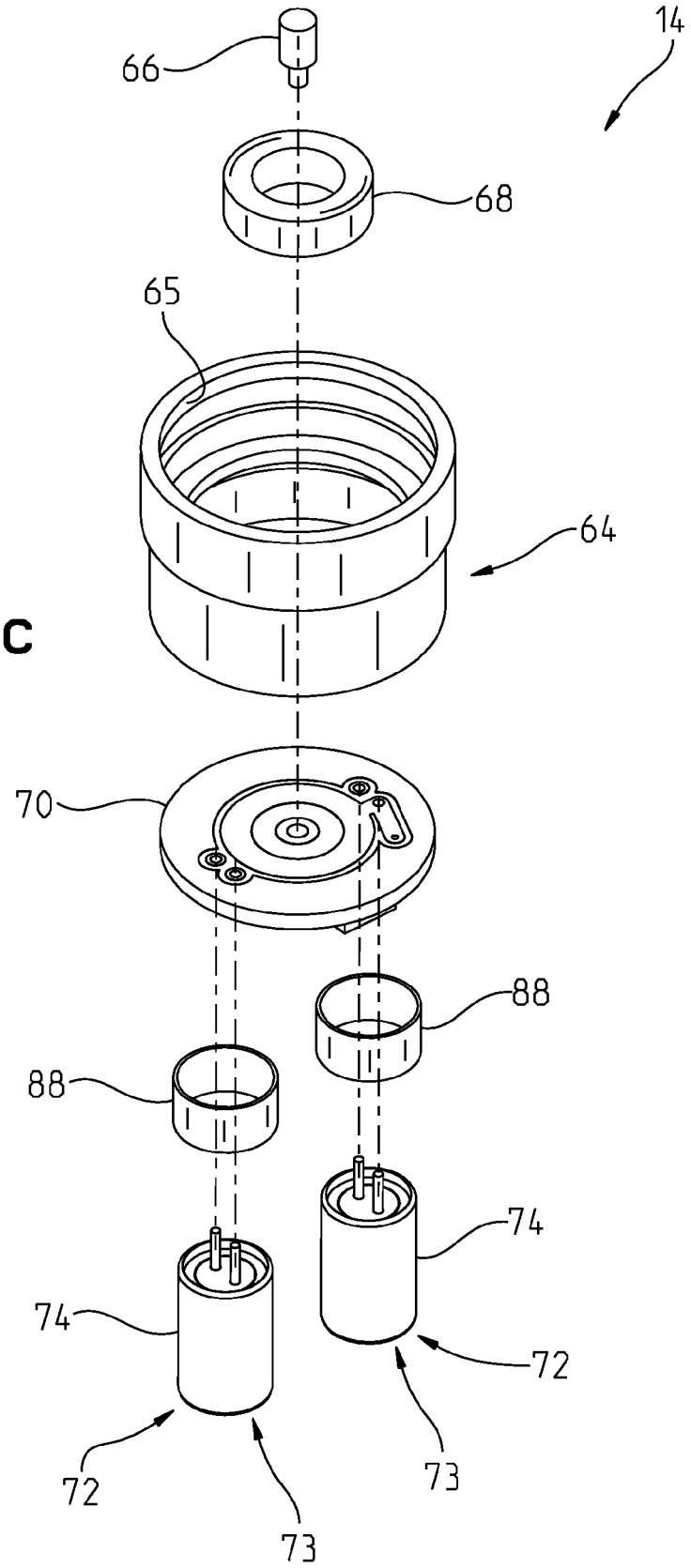
FIG. 3C is an exploded view of the impulse cartridge of FIG. 1.
Figure 4A:
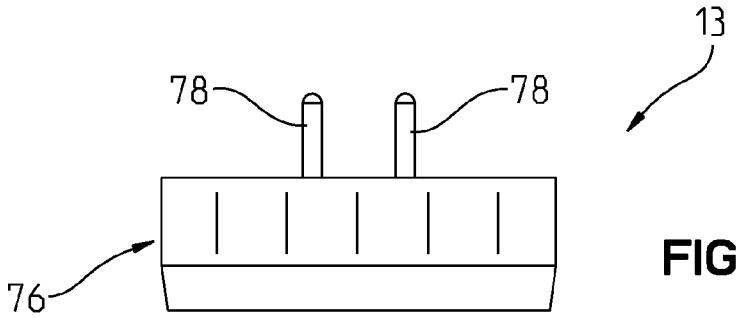
FIG. 4A is a plan view of the orientation adapter of FIG. 1.
Figure 4B:
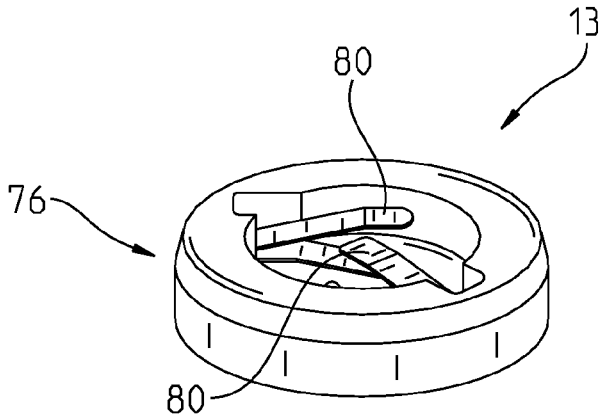
FIG. 4B is a bottom perspective view of the orientation adapter of FIG. 1.
Figure 4C:
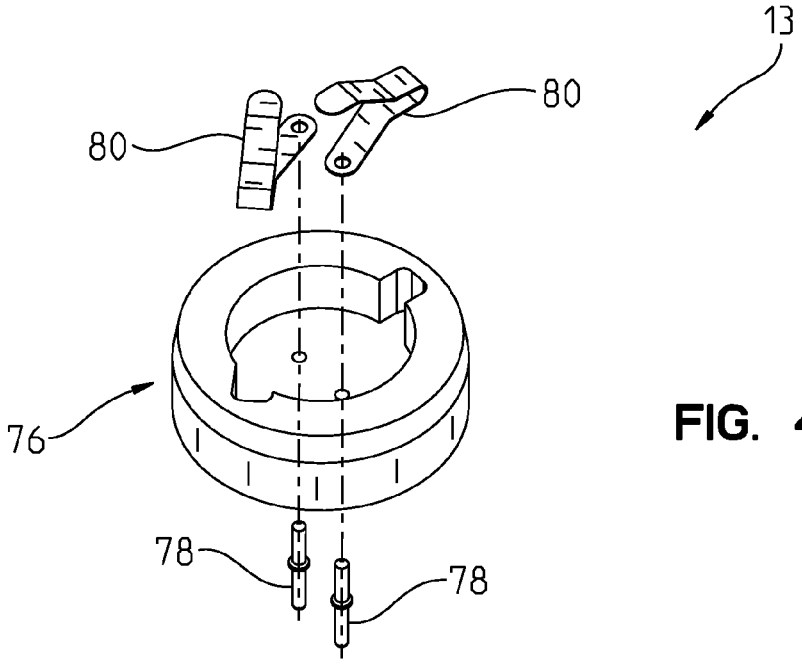
FIG. 4C is an exploded view of the orientation adapter of FIG. 1.

Impulse cartridge (I/C) 14, FIGS. 3A-C, is illustratively an electrically activated impulse cartridge. I/C 14 includes a substantially cylindrical housing 64, post contact 66, annular contact 68, circuitry 70, and squibs 72. Housing 64 is illustratively constructed from metal, such as aluminum. Housing 64 has an external profile sized to be received in bore 24. Housing 64 further includes connection bore 65 disposed therein. (Step 200)

Figure 7:
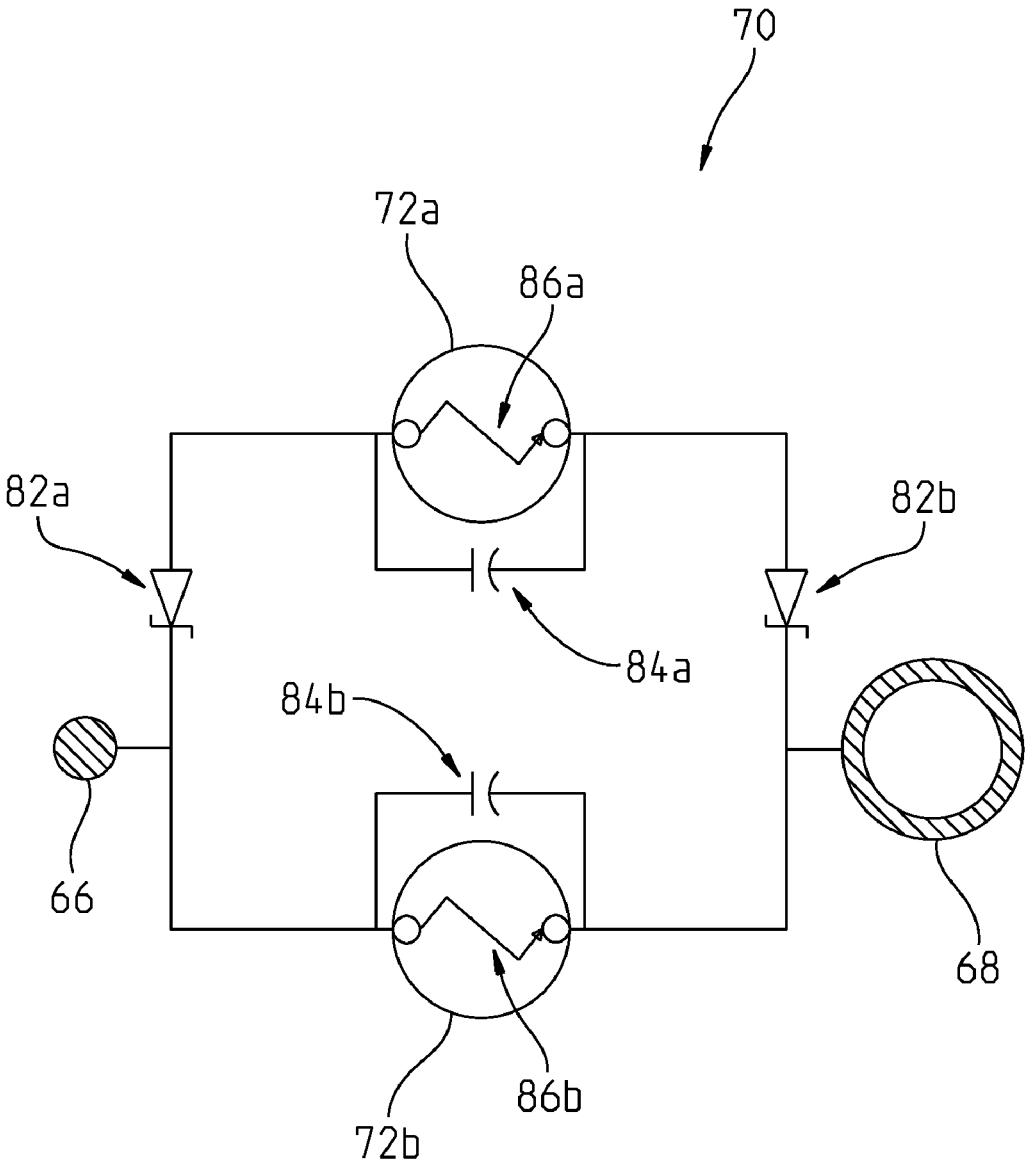
FIG. 7 is a schematic view of the circuitry present in the impulse cartridge of FIG. 1.
Figure 9:
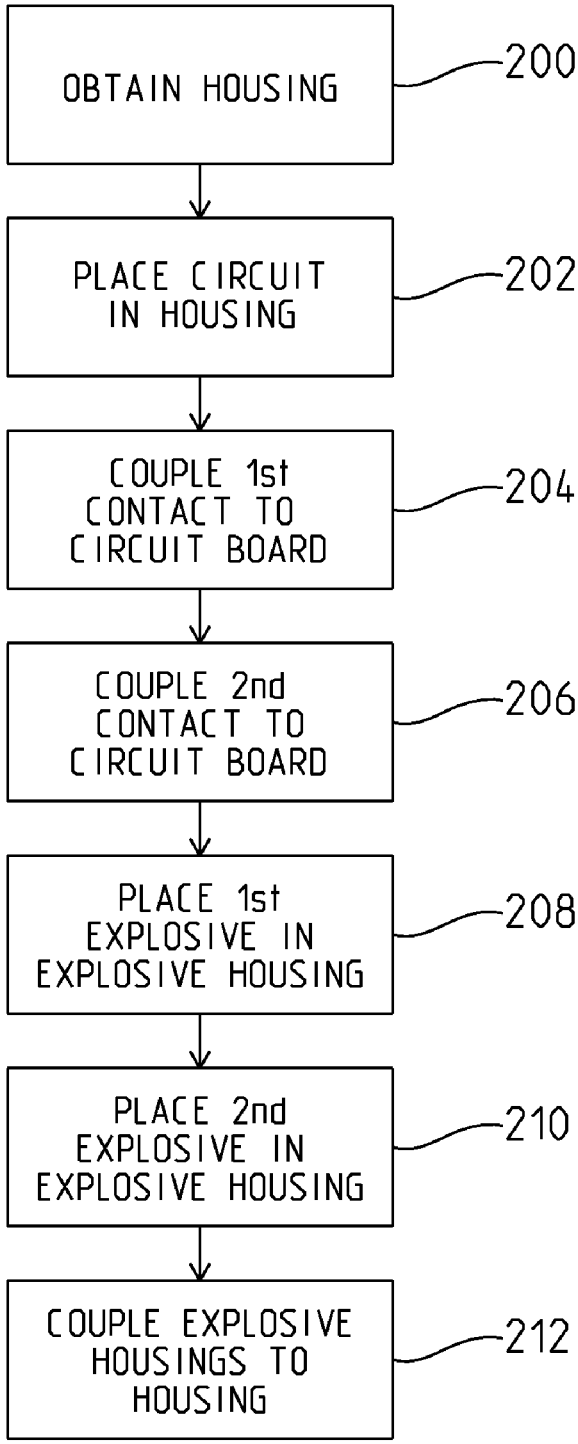
FIG. 9 is a flowchart showing the steps taken to assemble the impulse cartridge of FIG. 1.
Figure 10:
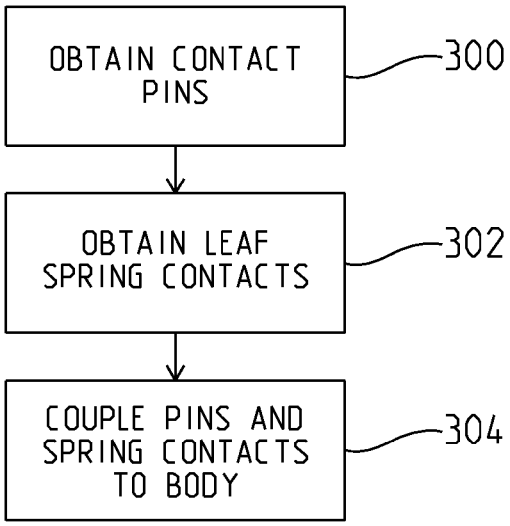
FIG. 10 is a flowchart showing the steps taken to assemble the orientation adapter of FIG. 1.
Figure 11:
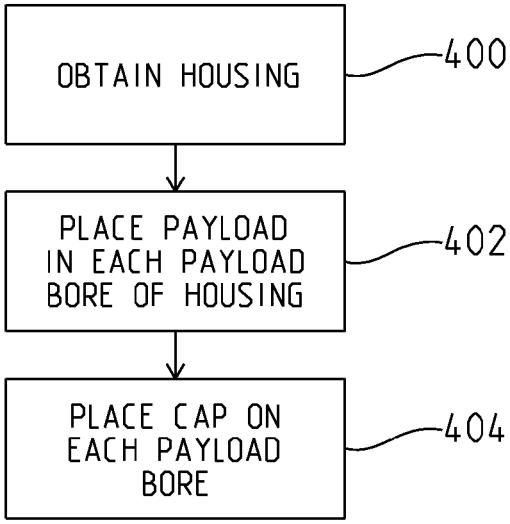
FIG. 11 is a flowchart showing the steps taken to manufacture the projectile device of FIG. 1.

Circuitry 70, FIG. 7, is located in bore 65, step 202, and is in electrical communication with post contact 66, step 204, and annular contact 68, step 206, and includes Zener diodes 82, capacitors 84, and bridge wires 86 within squibs 72. It should be appreciated that while FIG. 9 shows step 202 occurring before steps 204 and 206, steps 204 and 206 could occur before step 202. Squibs 72 are intended to fire based on two distinct and different firing voltages (a low and a high voltage) being provided from an external controller 90. Circuitry 70, when receiving a low voltage, allows direct current to flow to bridgewire 86*b* of squib 72*b* and inhibits current flow (via Zener diodes 82*a*&*b*) to bridgewire 86*a* of second squib 72*a*. Zener diodes 82*a*&*b* permit current flow in a forward direction like a normal diode, but also permit flow in the reverse direction if the supply voltage is larger than the breakdown voltage of diode 82. Hence, if the voltage applied is lower than the Zener breakdown voltage, squib 72*b* will see current at bridgewire 86*b* which will heat the wire and ignite ignition mix 71. Subsequently, bridgewire 86*a* of squib 72*a* will not see current flow until a higher voltage is applied and breaks down one of Zener diodes 82*a*&*b*. Given that Zener diodes 82 are directional, circuitry 70 is wired with two diodes 82 (one on each side of the high side squib 72*a*/bridge wire 86*a*) such that regardless of the polarity imparted on post contact 66 and annular contact 68, impulse cartridge 14 is able to operate as desired. Stated another way, for a first polarity, Zener diode 82*a* freely allows flow there across, but Zener diode 82*b* requires the application of a breakdown voltage before flow there across is allowed. Thus, because Zener diode 82*b* is in the same trace as Zener diode 82*a*, for the first polarity, Zener diode 82*b* must be broken down before flow through either Zener diode 82*a*&*b* is permitted. Similarly, for a second polarity, opposite the first polarity, Zener diode 82*b* freely allows flow there across, but Zener diode 82*a* requires the application of a breakdown voltage before flow there across is allowed. Thus, because Zener diode 82*a* is in the same trace as Zener diode 82*b*, for the second polarity, Zener diode 82*a* must be broken down before flow through either Zener diode 82*a*&*b* is permitted. Accordingly, regardless of the polarity of the applied voltage signal, one of the Zener diodes 82*a*&*b* must be broken down to allow the signal to reach bridge wire 86*a* of squib 72*a*. Controlling the voltage to I/C 14 results in the ability to independently fire the multiple bays of the ejector.

To allow impulse cartridge 14 to be HERO (Hazards of Electromagnetic Radiation to Ordnance) safe, various features were also incorporated into the design to reduce its sensitivity to outside electromagnetic radiation: housing 64 is constructed of an aluminum that is nickel plated; a flexible EMI absorption ferrite shield (not shown) is applied to the backside of impulse cartridge 14 between the post contact 66, annular contact 68 and the housing 64, and capacitors 84 are applied across bridge wires 86 of each squib 72.

Figure 6:
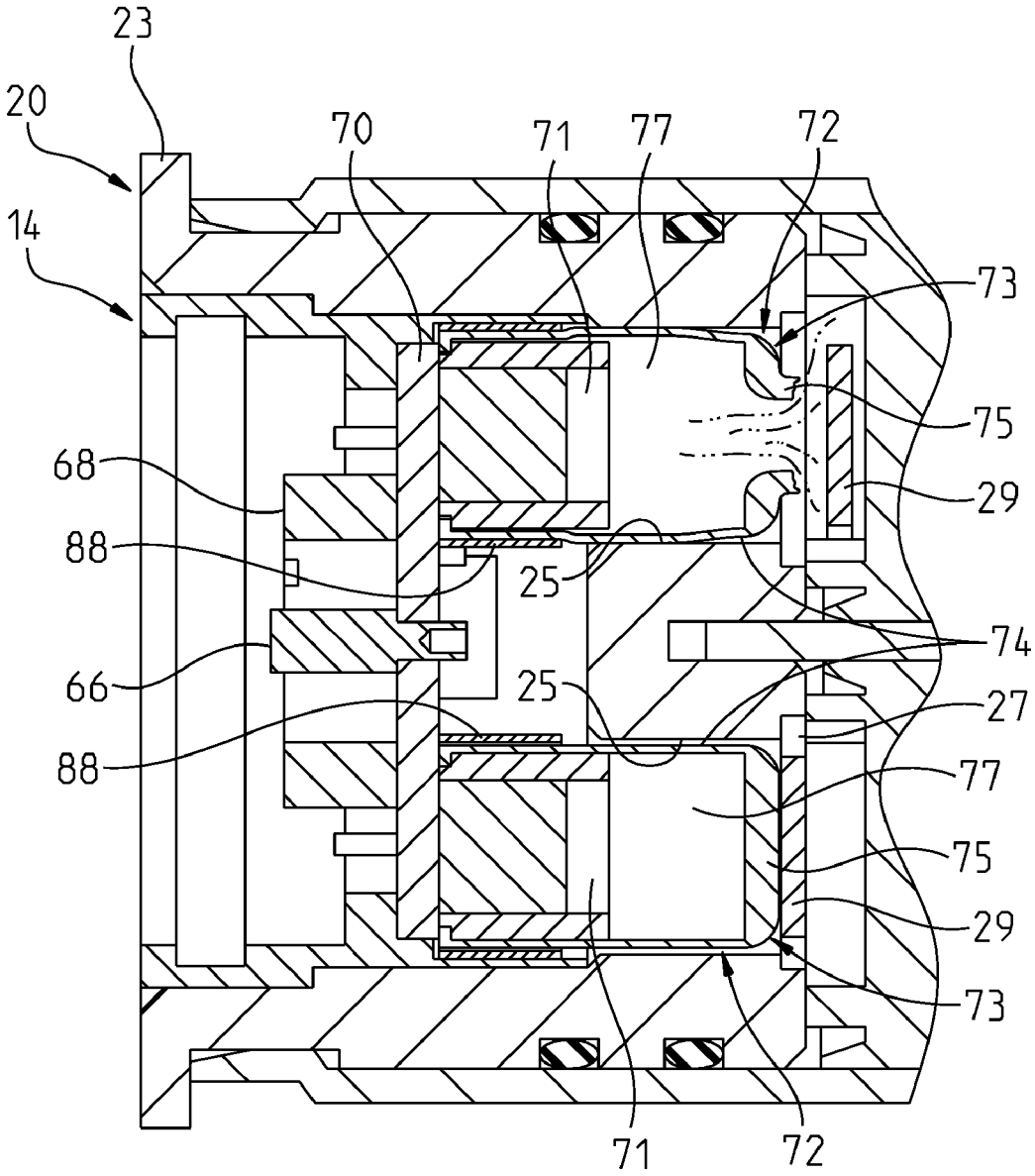
FIG. 6 is a cross-sectional view of the projectile device of FIG. 1 with one charge detonated.

Squibs 72 each include squib cups 73 that contain ignition mix 71 and expellant charge 77, steps 208, 210. Expellant charge 77 is illustratively smokeless powder and ignition mix 71 is a titanium and potassium perchlorate based blend. Ignition mix 71 is ignitable by an electric signal transmitted from circuitry 70 to bridge wire 86. Expellant charge 77 is ignitable by activated ignition mix 71. Squib cups 73 are constructed from soft aluminum, coupled to housing 64 (step 212), and sized to be a slip fit into cavity 25. When internally pressurized, the soft aluminum of each squib cup 73 is able to swell and expand outward and seal against the walls of cavity 25 and shown in FIG. 6. To prevent an undesired failure of squib cups 73 within impulse cartridge 14, stainless steel obturating rings 88 are installed around the portions of squib cups 73 retained within impulse cartridge 14 and not intended to swell. Furthermore, squib cups 73 are designed to predictably fail to allow the escape of pressurized gas into contact with shear disks 29. Accordingly, as the expellant charge is ignited and generates explosive pressure, the pressure first reaches a pressure that causes the sides of squib cups 73 to expand. As pressure continues to build to a second pressure, a second portion of squib cups 73, such as the bottoms, predictably fail to release the building pressure of hot gases and particulate. Squib cups 73 undergo hard coat anodizing. Hard coat anodizing of the aluminum squib cups 73 reduces the frictional force required to remove the fired impulse cartridge 14 or swelled squibs 72 from cavities 25 in the projectile device 10.

Orientation adapter 13 includes body 76, contact pins 78 (step 300), and spring contacts 80 (Step 302). Body 76 is sized to seat within connection bore 65. Body 76 is constructed from an electrical insulator such as plastic. Contact pins 78 extend from body 76. Contact pins 78 are further sized and spaced to be received in contact sockets (not shown) in breech plate 15. Contact pins 78 are electrically coupled to spring contacts 80 and the connection extends through body 76, step 304. Spring contacts 80 are illustratively copper beryllium leaf springs which have been copper, silver, and gold plated to interface with post contact 66 and annular contact 68. Post contact 66 and annular contact 58 are fabricated from brass and also copper, silver, and gold plated. The beryllium copper based spring contacts with aforementioned plating maintain continuity with post contact 66 and annular contact 68 in an operational environment. Spring contacts 80 are positioned such that when located within connection bore 65 of cartridge retainer 23 one spring contact 80 engages post contact 66 and one spring contact engages annular contact 68. As noted with respect to circuitry 70, it is irrelevant which of contact pins 78 is electrically coupled to each of spring contacts 80 and eventually post contact 66 and annular contact 68. Furthermore, circuitry 70 renders irrelevant which contact pin 78 engages which receiving bore (not shown) in breech plate 15. It should be appreciated that one spring contact 80 engages post contact 66 and one spring contact 80 engages annular contact 68 regardless of the angular orientation that the orientation adapter 13 assumes relative to I/C 14. Indeed, orientation adapter 13 can be rotated relative to I/C 14 when seated within connection bore 65 while maintaining electrical contact between orientation adapter 13 and I/C 14.

Figure 8:
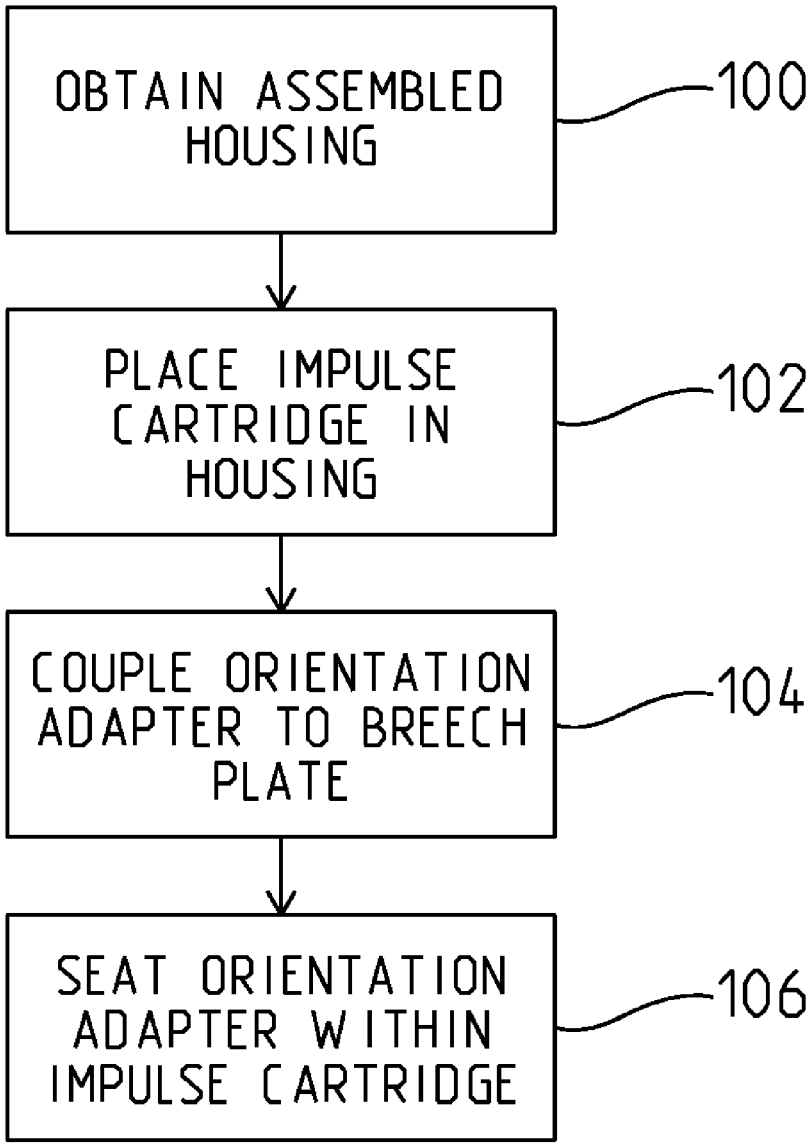
FIG. 8 is a flowchart showing steps taken to assemble the projectile device of FIG. 1.

Once projectile device 10 is assembled, step 100, FIG. 8, all of the components located in payload bore 30, including end cap 18 are assembled and stored in the assembled condition. In further assembly, at some point, such as just before being loaded into a magazine block 12, impulse cartridge 14 is seated within bore 24, step 102. When so placed, impulse cartridge 14 is aligned within bore 24 such that squib cups 73 are aligned with pockets 25. However, it should be appreciated that housing 16 and projectile device 10 may assume any rotational orientation when placed in block 12. Additionally, breech plate 15 defines a set orientation in which it can receive contact pins 78 of orientation adapter 13. Accordingly, orientation adapter 13 is electrically coupled to breech plate 15, step 104. This assembly is completed for a plurality of impulse cartridges 14, projectile devices 10, and orientation adapters 13.

Once projectile devices 10 with impulse cartridges 14 are placed in block 12 and orientation adapters 13 are coupled to breech plate 15, the plurality of orientation adapters 13 are placed within respective bores 24 to complete assembly, step 106. The assembled block 12 and breech plate 15 is then ready to be loaded into a receiver (not shown) and ready to be coupled to an ignition source (not shown).

However, it should be appreciated that un-activated impulse cartridge 14 can readily be separated from housing 16 without harming any of the components and maintaining a hermetic seal of device 10. Notably, when a magazine block 12 is removed from its receiver and projectile devices 10 are removed from the magazine block, impulse cartridges 14 are removed from bore 24 to allow independent storage of projectile device 10 having a decreased likelihood of unintentional activation. Accordingly, in an unpressurized (or ambiently pressurized) state, housing 16 provides a slip fit with impulse cartridge 14 that imparts a first coefficient of friction between housing 16 and housing 64 that is very low and only slightly discourages I/C 14 from falling out of bore 24. The first coefficient of friction can be easily overcome by an individual or automated process pulling I/C 14 from bore 24 or by gravity when inverting an assembled projectile device 10 while holding housing 16.

In use, when properly positioned, end cap 18 is aimed and contact pins 78 are coupled to controller 90 which includes a voltage source. When directed, controller 90 imparts a voltage to pair of contact pins 78. In the provided example, a first voltage (low voltage) imparted to contact pins 78 activates a first charge in squib 72 which contains ignition mix 71 and expellant charge 77. Activation of contain ignition mix 71 and expellant charge 77 causes a rapid gas expansion or pressure to be applied to sides 74 and bottom 75 of first squib cup 73. The outward expansion of sides 74 against bore 25 obstructs gases from flowing in a negative direction between squib cup 73 and bore 25. Eventually, bottom 75 predictably fails and allows gas to fill the innermost portion of bore 25. The gas is effectively trapped within squib cups 73 and bore 25. The seal formed by explosively forming the side 74 of the soft aluminum squib cups 73 to the wall of bore 25 prevents soot from coming into contact with the electronic elements that impart voltage to contact pins 78 and also provides for improved ballistic consistency of payload 34 by minimizing gases bypassing around impulse cartridge 14 and out the propellant end 20 of projectile device 10. When the pressure reaches a third level, portions of reduced wall thickness 27 in pressurized pocket 25 fracture and release shear disk 29. The pressurized gas and hot particulate is then able to expand into rear chamber 46 of payload bore 30. A firing of an projectile device 10 is expected to generate between 1400-2000 psi within rear chamber 46 and bore 24.

As gas and hot particulate accumulates in rear chamber 46 of payload bore 30, piston 36 is urged away from propellant end 20 and towards ejection end 22. This urging results in expelling/deployment of end cap 18 and payload 34 from payload bore 30. If needed, the hot particulate from squib 72 can be sufficient to provide ignition transfer to payload 34.

Although the disclosure has been described in detail with reference to certain preferred embodiments, variations and modifications exist within the spirit and scope of the disclosure as described and defined in the following claims.

The invention claimed is:

1. A method of manufacturing an ejection device including the steps of:

obtaining a housing, the housing having an ignition source receiving bore including a bore wall, the bore wall having a plurality of independently actionable shear disks, each independently actionable shear disk being associated with an independent payload bore located within the housing such that the shear disk, when seated, prevents pressure from passing from the ignition source receiving bore to one of the payload bores, and the shear disk, when unseated, allowing the transmission of pressure from the ignition source receiving bore to one of the payload bores;

placing an ejectable device within each payload bore of the housing;

placing a piston located between the shear disk and the ejectable device;

placing a cap on the end of each payload bore to contain the ejectable device within the payload bore;

wherein said bore wall extends through said housing and is adapted to permit said piston, ejectable device, and end cap to exit said housing, said bore wall further comprising a retaining structure adapted to receive and retain said shear disk in a seated mode and release said shear disk upon an ignition mode, said ignition mode comprising said transmission of pressure from the ignition source.

2. The method of claim 1, wherein each shear disk is located at the bottom of a pocket defined in the ignition source receiving bore, each pocket sized to receive a container of explosive charge therein.

3. The method of claim 2, wherein the ignition source receiving bore is further sized to receive an orientation adapter simultaneously with the containers of explosive charge.

4. The method of claim 3, wherein the containers of explosive charge include at least two charges.

5. The method of claim 4, wherein the orientation adapter includes two electrical input contacts and each of the at least two charges are able to be activated by applying a voltage to the two electrical input contacts.

6. The method of claim 5, wherein a first charge is activated by applying a first voltage to the electrical input contacts and a second charge is activated by applying a second voltage to the electrical input contacts, the first voltage being different than the second voltage.

7. The method of claim 1, wherein the housing presents a substantially cylindrical outward shape.

* * * * *